US009149709B1

(12) United States Patent
Schuster et al.

(10) Patent No.: US 9,149,709 B1
(45) Date of Patent: Oct. 6, 2015

(54) HINGED ARTICULATING CATCHER LEG GUARD

(71) Applicants: Jeff Schuster, Louisville, KY (US); Steve Behrens, Costa Mesa, CA (US); Scott Boyer, Valencia, CA (US)

(72) Inventors: Jeff Schuster, Louisville, KY (US); Steve Behrens, Costa Mesa, CA (US); Scott Boyer, Valencia, CA (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 14/501,843

(22) Filed: Sep. 30, 2014

(51) Int. Cl.
*A41D 13/00* (2006.01)
*A63B 71/12* (2006.01)
*A41D 13/05* (2006.01)

(52) U.S. Cl.
CPC ..... *A63B 71/1225* (2013.01); *A41D 13/0543* (2013.01); *A63B 2071/1258* (2013.01)

(58) Field of Classification Search
CPC .. A63B 71/1225; A41D 13/065; A61F 5/373; A61F 5/0123
USPC ..... 2/16, 22, 24, 911; 128/878, 881, 882; 602/16, 26
See application file for complete search history.

(56) References Cited

U.S. PATENT DOCUMENTS

| | | | | | |
|---|---|---|---|---|---|
| 4,409,689 | A | * | 10/1983 | Buring et al. | 2/22 |
| 4,493,316 | A | * | 1/1985 | Reed et al. | 602/16 |
| 4,884,561 | A | * | 12/1989 | Letson, Sr. | 602/16 |
| 5,561,857 | A | * | 10/1996 | Hoshizaki et al. | 2/22 |
| 5,611,080 | A | * | 3/1997 | Skottheim | 2/16 |
| 5,652,956 | A | * | 8/1997 | Hoshizaki et al. | 2/22 |
| 5,662,594 | A | * | 9/1997 | Rosenblatt | 602/16 |
| 6,775,845 | B2 | * | 8/2004 | Eghamn | 2/22 |
| 7,845,017 | B2 | * | 12/2010 | Godshaw et al. | 2/24 |
| RE43,395 | E | * | 5/2012 | Budda | 2/22 |

* cited by examiner

*Primary Examiner* — Tejash Patel
(74) *Attorney, Agent, or Firm* — Valenti, Hanley & Robinson, PLLC; Kevin T. Duncan

(57) ABSTRACT

This invention relates generally to a leg guard, an embodiment of which includes use in diamond sports. The leg guard contains an adjustable shin guard, thigh guard, and articulating knee allowing for movement mimicking the natural movement of the knee. The articulating knee opens and closes without gaps in protection, and locks into a standing position preventing the hyperextension of the knee.

28 Claims, 10 Drawing Sheets

HINGED ARTICULATING CATCHER LEG GUARD

FIELD OF INVENTION

This invention relates generally to sports equipment and more particular to an articulating protective piece for a jointed area, an embodiment of which is a leg guard for use in diamond sports (e.g. baseball). The articulating knee guard has an articulating knee joint allowing for natural range of motion and full protection of the knee area.

BACKGROUND OF THE INVENTION

Many leg guards, both for use in diamond sports as well as other uses, exist that provide some protection to the knee, thigh, and shin areas. In the case of diamond sports, these leg guards are designed to protect the player from injury to knee and lower leg caused by the impact of thrown balls or bats and collision with other players. Leg guards attempt to provide as much natural movement with minimal restriction to the player as possible while simultaneously providing maximum protection possible.

Leg guards for diamond sports have become more sophisticated with time. Prior art typically consist of a triple kneecap design, wherein three separate protective paddings come together to cover and protect the knee. Additional protective padding is in place to protect the thigh and shin portions of the leg. This type of guard typically has a high-impact resistant plastic covering the soft foam padding and webbing connecting the pads together. Some existing leg guards have a flexible component that is attached to the stationary knee padding and the shin guard padding that allows for leg guard to bend with the player as they move from a standing to crouching position; however, the triple kneecap design leg guards do not provide any sort of protection from overextension of the knee.

Knee guards for use in motocross have an articulated knee design; however, problems exist with these designs for use in a diamond sport setting. Many of these knee guards have only a single articulation point, and function such that when the knee bends or articulates the articulating pieces move leaving large gaps between the articulating pieces. Furthermore, the articulating pieces of motocross knee guards have protruding plastic segments that in a diamond sport setting would function as a scoop or shovel for collecting dirt and debris. The collection of dirt and debris in these gaps and protruding areas would lead to build up in the articulating apparatus impairing the ability articulate properly and would ultimately minimize the range of motion. Additionally, articulating knee guards designed for use in motocross have a limited range of motion compared to the need for nearly full range of motion in diamond sports.

The balance between protection from injury and freedom of movement is the ultimate struggle in protective equipment for athletics. One key problem with existing leg guards for diamond sports is that while some contain flexible components, they still do not allow for natural movement of the knee joint and provide no protection for hyperextension of the knee. Furthermore, the flexing movement with the stationary position of the knee and shin padding allows for vulnerable areas of the body during certain positions. Problems with leg guards designed for motocross in the context of their use in diamond sports include: 1) the articulation apparatus is not designed to handle excess dirt and debris required of any protective gear used in baseball; and, 2) they do not provide for range of motion required for use in diamond sports. There exists a need in the art for a leg guard that has a hinged joint mimicking the natural movement and range of motion of the knee while preventing hyperextension, allowing for greater protection while in the standing or crouching positions, while being able to withstand the dirt and debris of diamond sports.

SUMMARY OF THE INVENTION

The present invention was developed to improve performance leg guards for use in diamond sports. Specifically, with leg guards for diamond sports the focus is on the protection of the knee, shin, and thigh areas from high-speed impact from balls, bats or collisions with other players. With regard to the knee specifically, the present invention prevents the hyperextension of the knee that can occur through the course of play. The articulating or hinged nature of the leg guard in the present invention allows for maximum protection while promoting the most natural range of motion during play.

The present invention provides a leg guard that allows for protection from frontal and side impact injuries relating to the knee and lower leg by utilizing a hinged area with arches that pivot from a common side pivot point mimicking the natural movement of the leg, while locking in place to aid in prevention of hyperextension of the knee. The problem with previous leg guards designed for diamond sports is that they are limited in allowing natural knee and leg movement and provide no protection against hyperextension of the knee. The problem with leg guards designed for other uses is, while articulating, they leave gaps in protection where impact injuries could occur and dirt and debris could build up in the hinged area.

With the present invention, the knee cup preferably comprises two arches that smoothly articulate upward and downward from two pivot points providing full range of motion following the natural anatomical movement of the knee, while maintaining full protection of the knee. When in a fully articulated open position, the present invention leaves no gaps between the arches and knee cup, providing complete protection of the knee and surrounding areas. Additionally, when in a fully articulated open position, the present invention does not contain any protruding areas where dirt or debris could build up and slow or jam the pivot point. When in a fully articulated closed position, the presented invention locks into place, which minimizes the risk of hyperextension to the knee. The present invention also provides protection for the upper thigh area, shin area, and the top of the foot with high-impact resistant plastic and foam padding.

The present invention may be used as leg guards for diamond sports, as designed, additional sports where protection of the lower leg, or any use where protection of a joint is important while also maintaining full range of motion.

In one embodiment, the present invention provides a leg guard comprising: a shin guard comprising high-impact resistant plastic; a thigh guard comprising high-impact resistant plastic; an articulating knee guard comprising high-impact resistant plastic and disposed intermediate of said shin guard and said thigh guard, said articulating knee guard movingly connected to a pair of side pivot plates, said thigh guard, knee guard, and said shin guard being attached to side pivot plates, whereby said thigh guard, knee guard, and shin guard are adapted to pivot between a closed position and an open position upon movement of user from a standing to a crouched position and to fully cover the front and sides of a user's knee through a full range of motion; padding disposed on the interior of the leg guard and attached to one or more of the shin guard, thigh guard, and knee guard; and means for securing the leg guard to the leg of a user. The leg guard may further comprise a metatarsal plate comprising high-impact resistant plastic attached to said exterior layer and further comprising protective discs for the ankles. The shin guard may further comprise a lower shin guard and an upper shin guard. The shin guard may further comprise a means for adjusting the length of the shin plate including an adjustment mechanism allowing the insertion of an additional piece of high-impact resistant plastic. The leg guard may further comprise a set of flexible padded layers adapted to be joined to the thigh guard, knee guard, and shin guard. The interior padding may further comprise a shin pad and a means for attaching foam padding to the high-impact resistant plastic. The shin guard may further comprise winged side panels comprising a flexible layer having an interior padded layer and an exterior layer wherein the exterior layer comprises high-impact resistance plastic and the interior padded layer further comprises flexible memory foam padding specific to either the right or left leg. The shin guard may further comprise an articulating arcuate joint portion connected to side pivot plates. The interior padding of the articulating knee may further comprise a knee pad, surrounding by knee doughnut, and adjustable memory foam side panel knee pads. The leg guard may further comprise: the thigh guard having an upper stop ridge; the shin guard having a lower stop ridge; the knee guard having a protruding portion forming an upper ledge and a lower ledge adapted to engage respectively the upper stop ridge and lower stop ridge of said upper articulating arcuate joint portion and said lower articulating arcuate joint portion to limit further articulation when fully closed; and wherein the upper and lower articulating arcuate joint portions and the central articulating portion are connected to the pivot points on the pair of side pivot plates. The articulating system may be configured to articulate greater than ninety degrees without leaving areas unprotected. The thigh guard may further comprise a set of engaging tabs and engaging protrusion, the central articulating portion comprises an upper and lower engaging ridge, and the shin guard may further comprise an upper engaging ridge, configured to limit range of motion to prevent hyperextension of user's knee. The pair of side pivot plates may further comprise an upper and lower pivot point wherein the shin guard and knee guard are connected to the lower pivot point, and the knee guard and thigh guard are connected to the upper pivot point. The leg guard may further comprise an intermediate articulating portion is positioned between the thigh guard and knee guard. The intermediate articulating portion may further comprise an engaging protrusion. The pair of side pivot plates may further comprise an upper and lower pivot point wherein the intermediate articulating portion connects to the upper pivot point.

In another embodiment, the present invention provides an articulating protective piece for a body joint comprising: an upper articulating arcuate joint portion having an upper stop ridge; a lower articulating arcuate joint portion having a lower stop ridge; a central articulating portion having a protruding portion forming an upper ledge and a lower ledge adapted to engage respectively the upper stop ridge and lower stop ridge of said upper articulating arcuate joint portion and said lower articulating arcuate joint portion to limit further articulation when fully closed; and left and right double articulating pivot plates having a set of pivot points; wherein the upper and lower articulating arcuate joint portions and the central articulating portion are connected to the pivot points on the left and right double articulating pivot plates. The articulating protective piece may be configured to articulate greater than ninety degrees without leaving areas unprotected. The articulating protective piece may further comprise an intermediate articulating portion disposed intermediate between said upper and central portions. The intermediate articulating portion may further comprise an upper and lower edge, an intermediate engaging ridge positioned on said upper edge, and an intermediate stop ridge positioned on said lower edge. The left and right double articulating pivot plates may further comprise an upper pivot point and lower pivot point, the intermediate articulating portion connected to the upper pivot point. The articulating protective piece may further comprise: an intermediate articulating arcuate portion having an upper and lower edge, an intermediate engaging ridge disposed on said upper edge, and an intermediate stop ridge disposed on said lower edge; the upper articulating arcuate joint portion further comprising a set of engaging tabs adapted to engage said upper edge of said intermediate articulating arcuate portion; the central articulating portion further comprising an upper and lower engaging ridge, said upper engaging ridge adapted to engage said intermediate stop ridge, and said lower engaging ridge adapted to engage said lower stop ridge. The left and right double articulating pivot plates may further comprise a lower pivot point and an upper pivot point wherein the lower articulating arcuate joint portion and central articulating portion are connected to the lower pivot point, and the central articulating portion and upper articulating arcuate joint portion are connected to the upper pivot point. The upper articulating arcuate joint portion may further comprise interior flexible foam padding. The central articulating portion may further comprise interior flexible foam padding, a gel pad, and adjustable side foam padding. The lower articulating arcuate joint portion may further comprise a shin guard portion with interior foam padding and gel pad. The shin guard may further comprise winged side panels comprising a flexible layer having an interior padded layer and an exterior layer wherein the exterior layer comprises high-impact resistance plastic and the interior padded layer further comprises flexible memory foam padding specific to either the right or left leg.

BRIEF DESCRIPTION OF THE DRAWINGS

In order to facilitate a full understanding of the present invention, reference is now made to the accompanying drawings, in which like elements are referenced with like numerals. These drawings should not be construed as limiting the present invention, but are intended to be exemplary and for reference.

DETAILED DESCRIPTION

The present invention will now be described in more detail with reference to exemplary embodiments as shown in the accompanying drawings. While the present invention is described herein with reference to the exemplary embodiments, it should be understood that the present invention is not limited to such exemplary embodiments. Those possessing ordinary skill in the art and having access to the teachings herein will recognize additional implementations, modifications, and embodiments, as well as other applications for use of the invention, which are fully contemplated herein as within the scope of the present invention as disclosed and claimed herein, and with respect to which the present invention could be of significant utility.

Figure 1C:
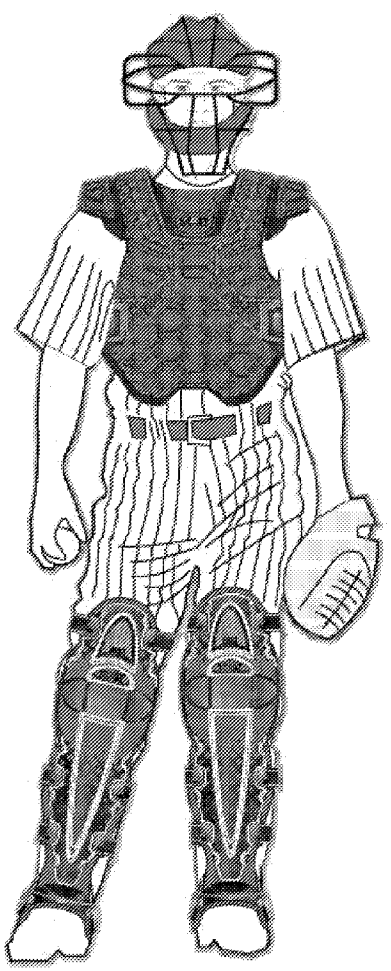
FIG. 1C is a front view of a second embodiment of a leg guard worn by a baseball player in accordance with the present invention.
Figure 1B:
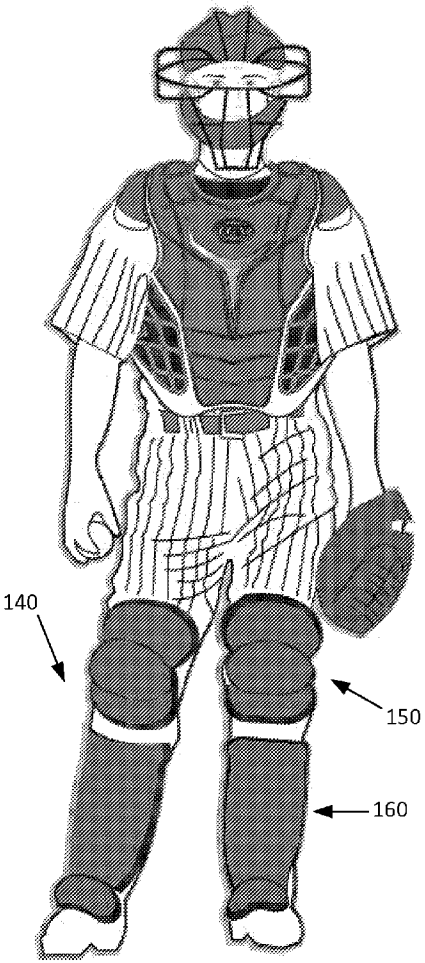
(PRIOR ART) FIGURE 1B
FIG. 1B is a front view of an embodiment of prior art worn by a baseball player.
Figure 1A:
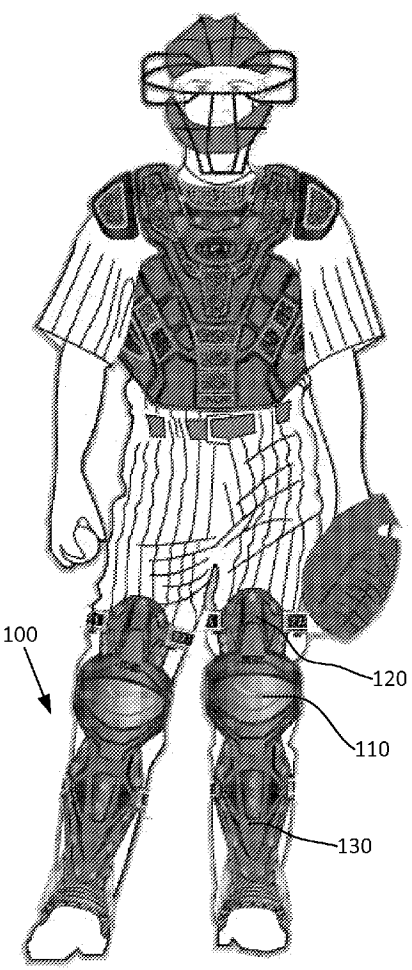
FIG. 1A is a front view of a first embodiment of a leg guard worn by a baseball player in accordance with the present invention.

With reference to FIG. 1A, a first exemplary embodiment of the present invention is shown worn by a baseball player. The leg guard 100 comprises the articulating hinged knee portion 110 and the connected thigh portion 120 and shin portion 130. In this embodiment, the leg guard 100 is removably attached to a player in a standing position causing the hinged knee to be in a closed position. FIG. 1B shows an embodiment of prior art leg guards 140 as worn by a baseball player in the standing position. The prior art contains triple kneecap protection 150, consisting of three protected areas covering the knee and thigh areas. The prior art also contains a shin protector 160. The triple kneecap design, shown as part of the prior art, allows for movement of a player from the standing to crouching position, but does not follow the natural movement of the knee. The triple kneecap design does not provide a stop mechanism to protect the player from hyperextension of the knee. FIG. 1C is a second exemplary embodiment of the present invention as shown worn by a baseball player.

Figure 2:
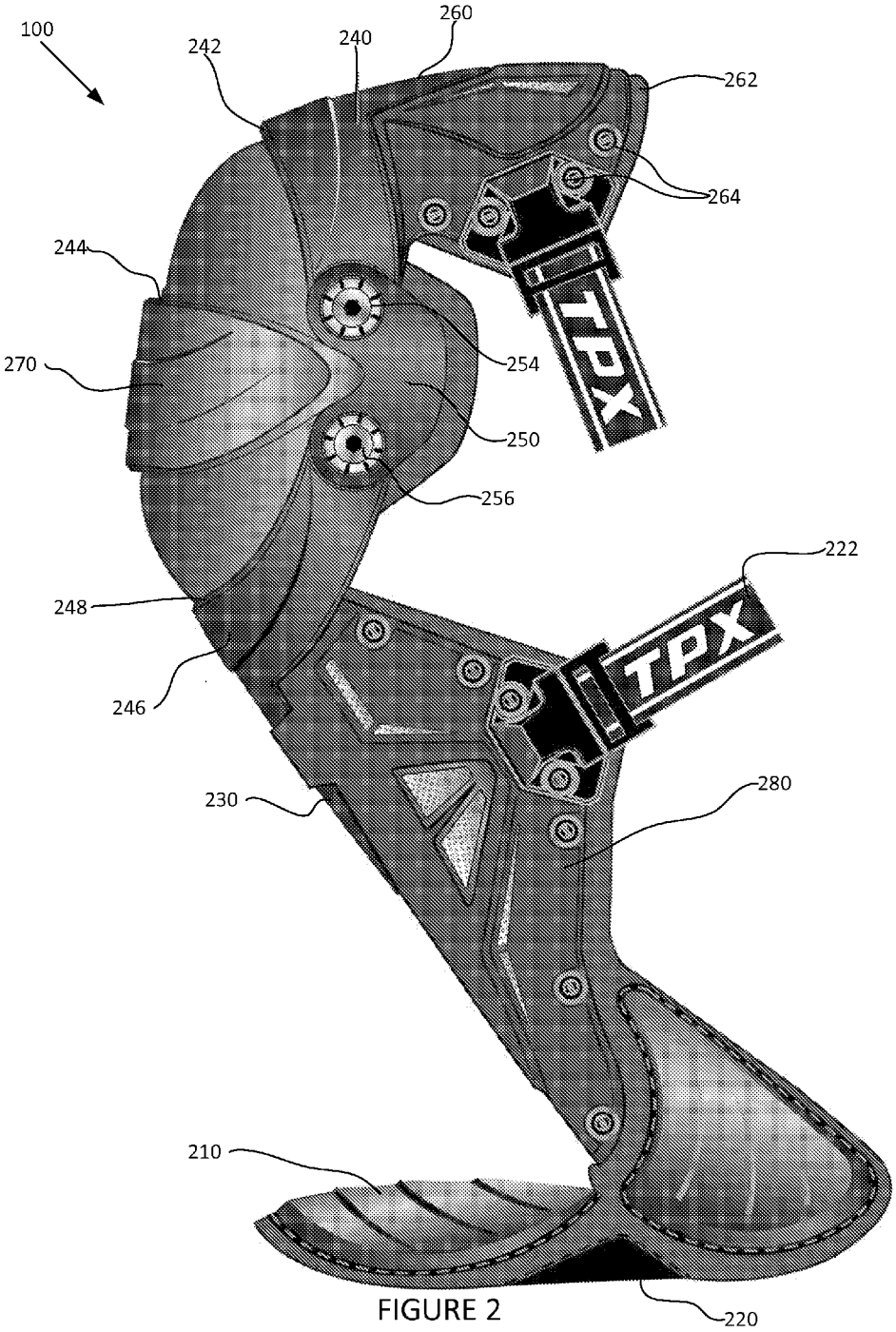
FIG. 2 is a side view of the leg guard of FIG. 1A in a crouching position with the hinged knee in a fully articulated open position.

With reference now to FIG. 2, a side view of the leg guard 100 of FIG. 1A in a crouching position, showing the hinged knee in an articulated open position. The leg guard comprises impact resistant footpads 210 with a sewn in elastic panel 220 to ensure that the footpads stay in place, adjustable shin guard portion 230, and adjustable elastic straps 222 to ensure proper fit for varying leg widths and that the leg guard stay in proper position throughout the game. The elastic straps 222 are one embodiment of a means for securing the leg guard, other possible securing means could include Velcro, hook and anchor, buttons, etc. The portion of the guard covering the knee consists of two arches, an upper articulating arcuate joint portion 240 and a lower articulating arcuate joint portion 246, that are movably attached to two side pivot plates 250 (one on each side of the leg guard 100) so as to pivot about an upper pivot point 254 and a lower pivot point 256 on each side of the pivot plate 250. Alternatively, the upper 240 and lower 246 articulating arcuate joint portions could attach to a single point of articulating rather than having an upper pivot point 254 and a lower pivot point 256. In this perspective, it can clearly been seen that the upper articulating arcuate joint portion 240 and the lower articulating arcuate joint portion 246 have smoothly pivoted open, without protrusions where dirt and debris could be trapped. The upper articulating arcuate joint portion 240 includes a lower engaging ridge 242 curving inward in order to prevent dirt and debris from entering the knee area and guide the articulation. The lower articulating arcuate joint portion 246 includes an upper engaging ridge 248 curving inward in order to prevent dirt and debris from entering the knee area and guide the articulation. Each side pivot plate 250, upper pivot point 254, and lower pivot point 256 follow the natural anatomical movement of the upper and lower leg without gaps in protection and provide support to the kneecap and knee joint. The pivot plates 250 are connected to the knee cup/central articulating portion, 270 that is preferably padded. The central articulating portion contains a protrusion 244, so that when the hinged knee is in the fully articulated open position that creates an internal cavity for additional padding. When in the standing, fully closed, position the protrusion 244 engages with lower engaging ridge 242 to limit further articulation to prevent the knee from hyperextending and causing injury. Additionally, the upper articulating arcuate joint portion 240 and the lower articulating arcuate joint portion 246 provide support for the upper thigh impact panel 260 and the lower shin guard portion 230. The upper thigh impact panel 260 is lined with a padded foam liner 262 for further support and protection of the thigh area. This panel is secured to the upper articulating arched panel 240 by rivets 264 or other suitable connector. The lower shin guard portion 230 has flexible, padded, winged side panels 280 for additional protection for the side of the player's leg. The rigid portions of the leg guard 100 may be made from any rigid, impact resistant material including, but not limited to, ABS plastic or polycarbonate.

Figure 3:
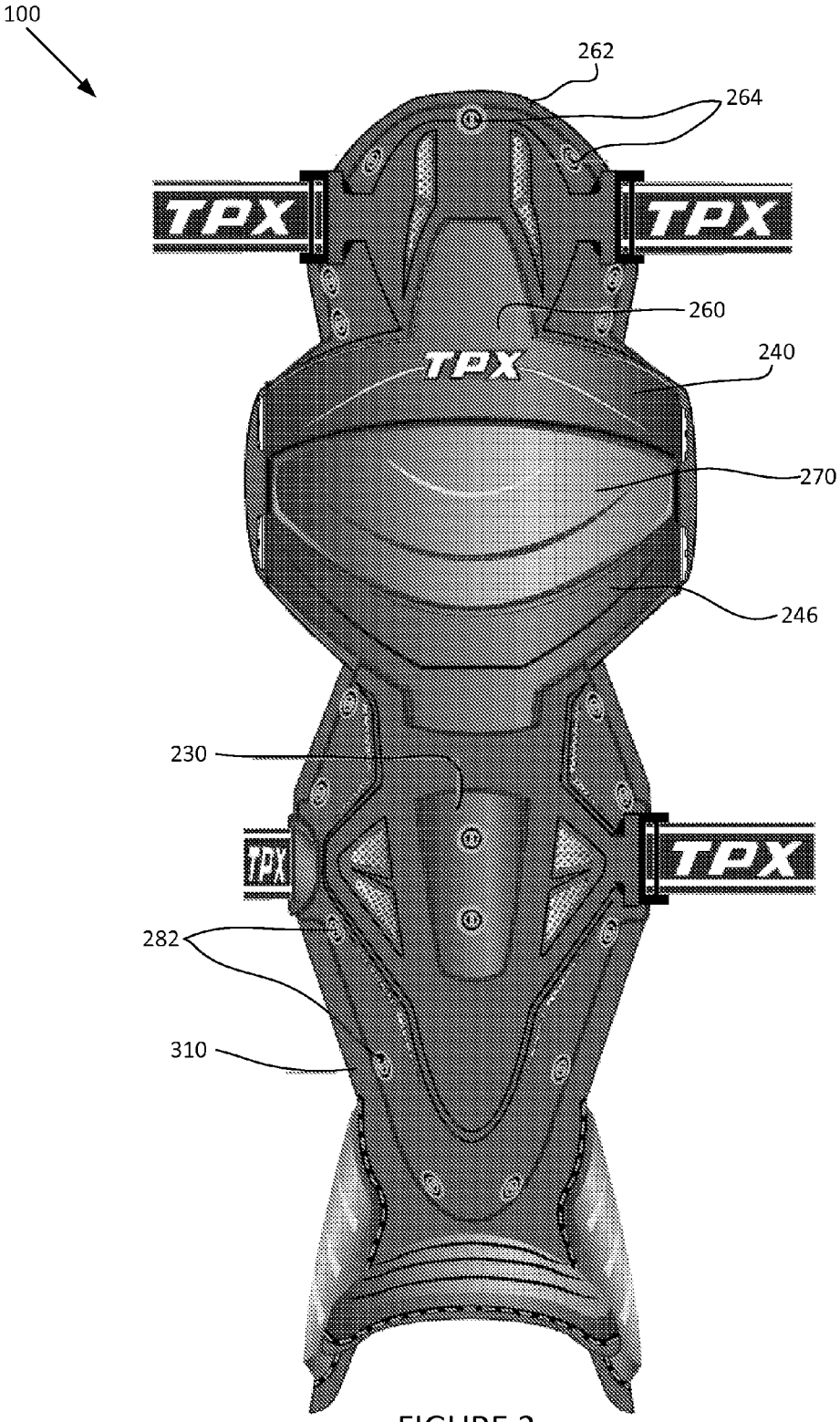
FIG. 3 is a front view of the leg guard of FIG. 1A in a standing position with the hinged knee in a fully closed position.

With reference now to FIG. 3, a front view of the leg guard 100 in a standing position with the hinged knee in a closed position. In this perspective, it can clearly be seen that the leg guard is in a standing, fully closed, position and that the upper articulating arcuate joint portion 240 and the lower articulating arcuate joint portion 246 are closed. The overlap generated by the upper and lower articulating arcuate joint portions and the remainder of the knee cup/central articulating portion 270 provides additional protection from frontal impact in a standing position. The central articulating portion 270 and the upper 240 and lower 246 articulating arcuate joint portions prevent further articulation when in this standing position through engagement of the protrusion 244 with the engaging ridge 242, which prevents the knee from articulating beyond this standing position in order to minimize the risk of hyperextension of the knee. The adjustable shin guard portion 230 provides for adjustment of the leg guard to accommodate players of varying heights. The shin guard portion is lined with additional foam padding 310 for protection of the remainder of the shin area. This foam padding is secured to the shin plate 230 through rivets 282 or other suitable connector. In this perspective the front of the upper thigh panel 260 and the corresponding foam liner 262 connected by rivets 264 can be seen in a standing, fully closed, position. The thigh and shin guards and padding may contain vent holes to facilitate the movement of air through the leg guard for the comfort of the user.

Figure 4:
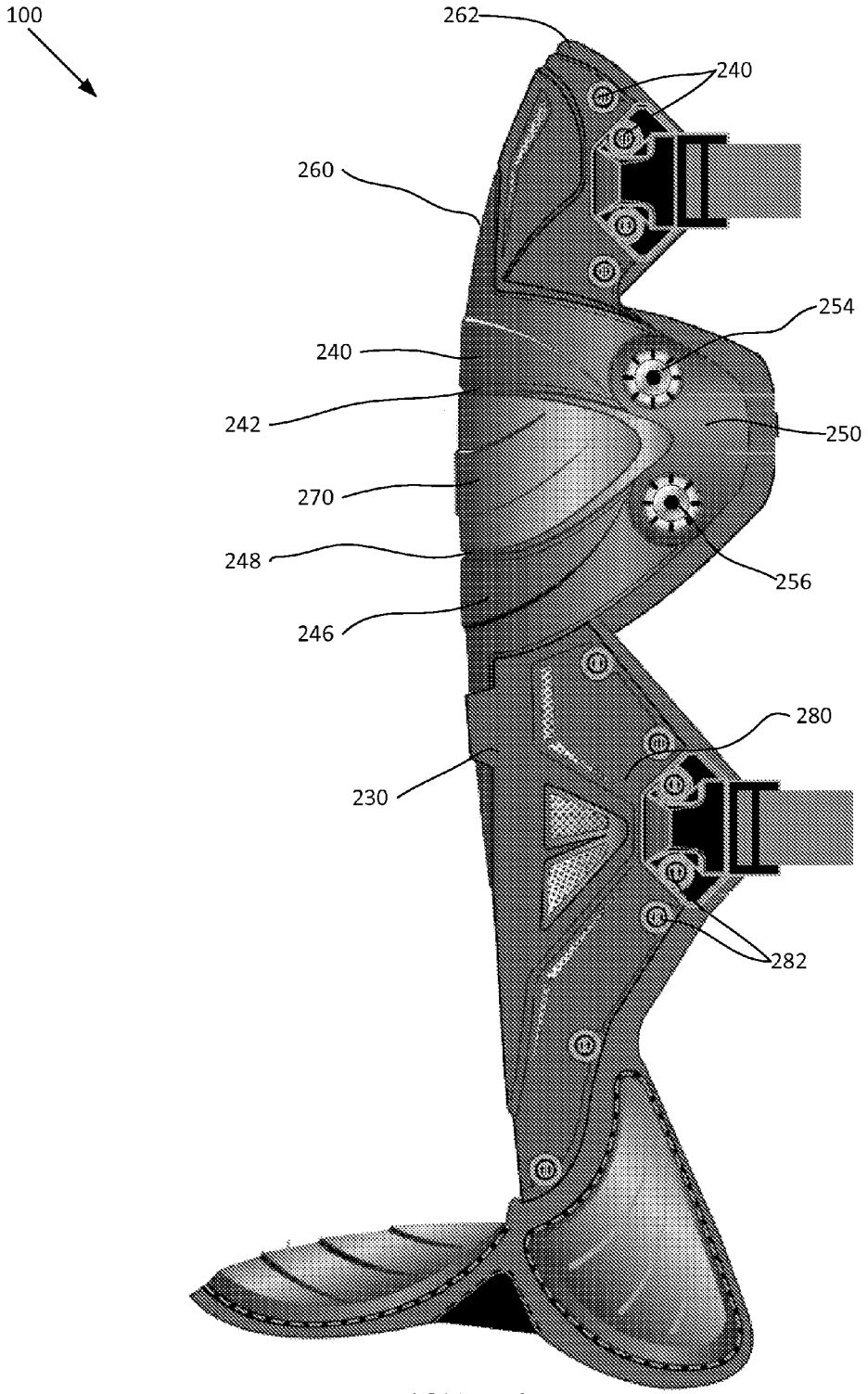
FIG. 4 is a side view of the leg guard of FIG. 1A in a standing position with the hinged knee in a fully closed position.

With reference now to FIG. 4, a side view of the leg guard 100 in a standing position with the hinged knee in a fully closed position. This perspective, in contrast to the perspective shown in FIG. 2, shows the articulated knee in a closed position. The upper articulating arcuate joint portion 240 and lower articulating arcuate joint portion 246, when closed, overlap with the remainder of the full surround knee cup/central articulating portion 270. This overlap provides further protection to the knee area from frontal impact to the knee while in a standing position. The upper articulating arcuate joint portion 240 is attached to each side pivot plate 250 at the upper pivot point 254, while the lower articulating arcuate joint portion 246 is attached to each side pivot plate 250 at the lower pivot point 256. The lower edge of the upper articulating arcuate joint portion 240 contains an engaging ridge 242 curving inward. The upper edge of the lower articulating arcuate joint portion 246 also contains an engaging ridge 248. Together, these engaging ridges prevent dirt and debris from entering the knee area and guide the articulation of the knee. The central articulating portion 270 and upper 240 and lower 246 articulating arcuate joint portions can prevent further articulation in this standing position, preventing the knee area from moving forward beyond this in order to minimize the risk of hyperextension of the knee. A side view of the upper thigh impact panel 260 and the surrounding foam liner 262, which, for example, is connected by rivets 264, can be seen in a standing position. The lower shin guard portion 230 surrounded by flexible, padded, winged side panels 280 attached by rivets 282 or other suitable means protects the leg from side impact by balls or bats, can also be seen in this perspective.

Figure 5:
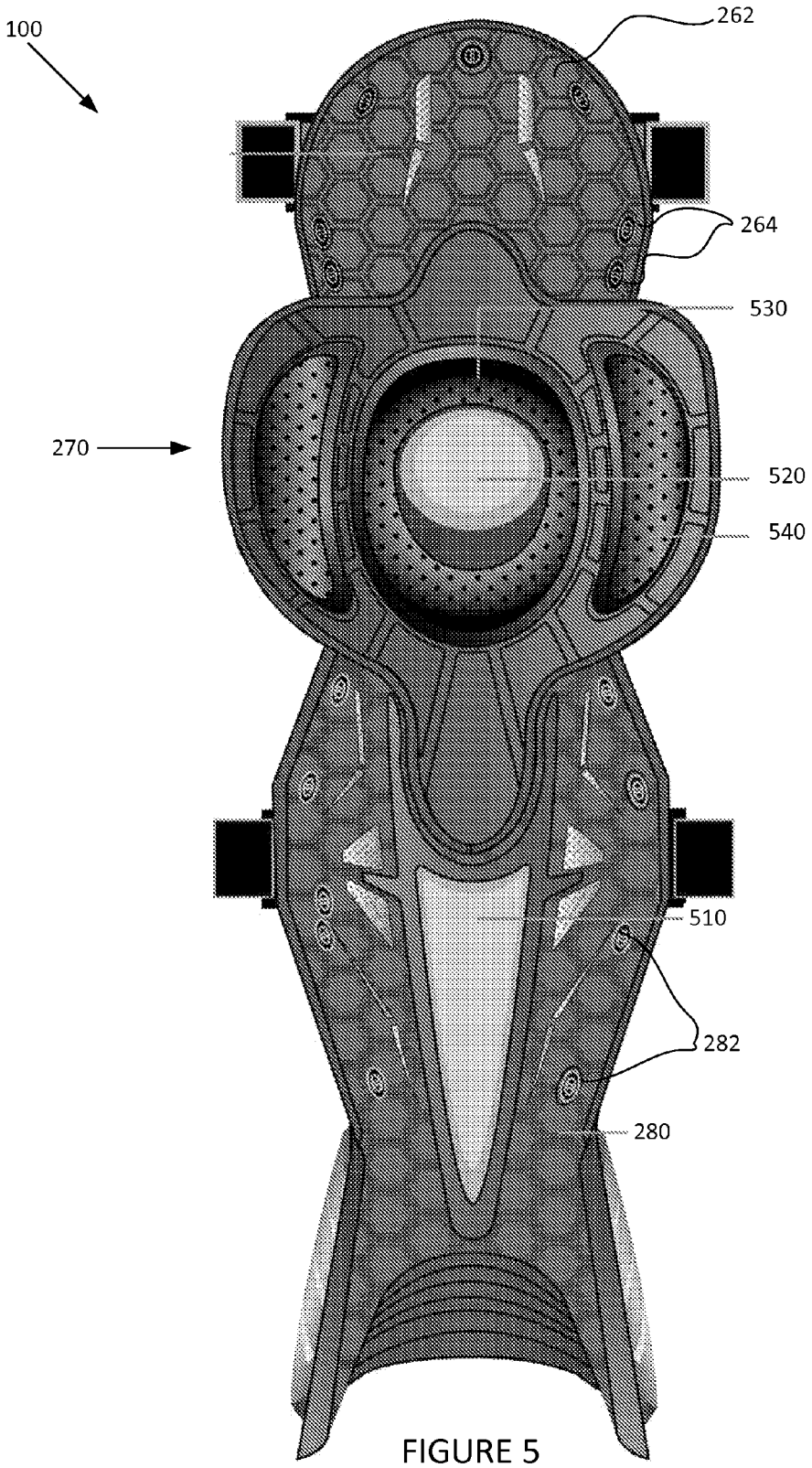
FIG. 5 is a rear view of the leg guard of FIG. 1A in a standing position.

With reference now to FIG. 5, a rear view of the leg guard 100 is shown in a standing position. This perspective shows the rear or interior view of the flexible winged side panels 280 for the lower legs and the padding that is attached by rivets 282 or other suitable means. Encompassing the shin area is a gel shin pad 510 for protection of the shin from impacts from balls, bats, or other players. In this embodiment, gel padding is used in the shin pad 510. However, other padding materials such as EVA foam, Poron XRD, memory foam, Advanced Impact Composite, polymer blend, vinyl nitrile, self-skinned urethane foam, and gel impact pads may be used as padding materials. This perspective also provides a rear or interior view of the full surround knee cup 270. In this perspective it is clear that the full surround knee cup is comprised of a gel knee pad 520, surrounded by memory foam knee doughnut 530, and memory foam side panel knee pads 540. The gel knee pad 520 is completely surrounded by the memory foam knee doughnut 530, and together these provide support, comfort, and shock absorption for any frontal impact to the knee. The memory foam side pads 540 provide support for the knee and protection from side impact to the knee. This invention is not limited to the particular padding and arrangement described and a person of ordinary skill in the art may use additional or other padding materials for the different paddings described, which may include alternative foam or gel paddings. The side panels 540 are adjustable, allowing for adjustment and better fit to individual players. Additionally, the foam padding for protection of the thigh area 262 is also secured by rivets 264 as can been seen from this perspective.

Figures 6A, 6B, 6C, 6D, 6E, 6F:
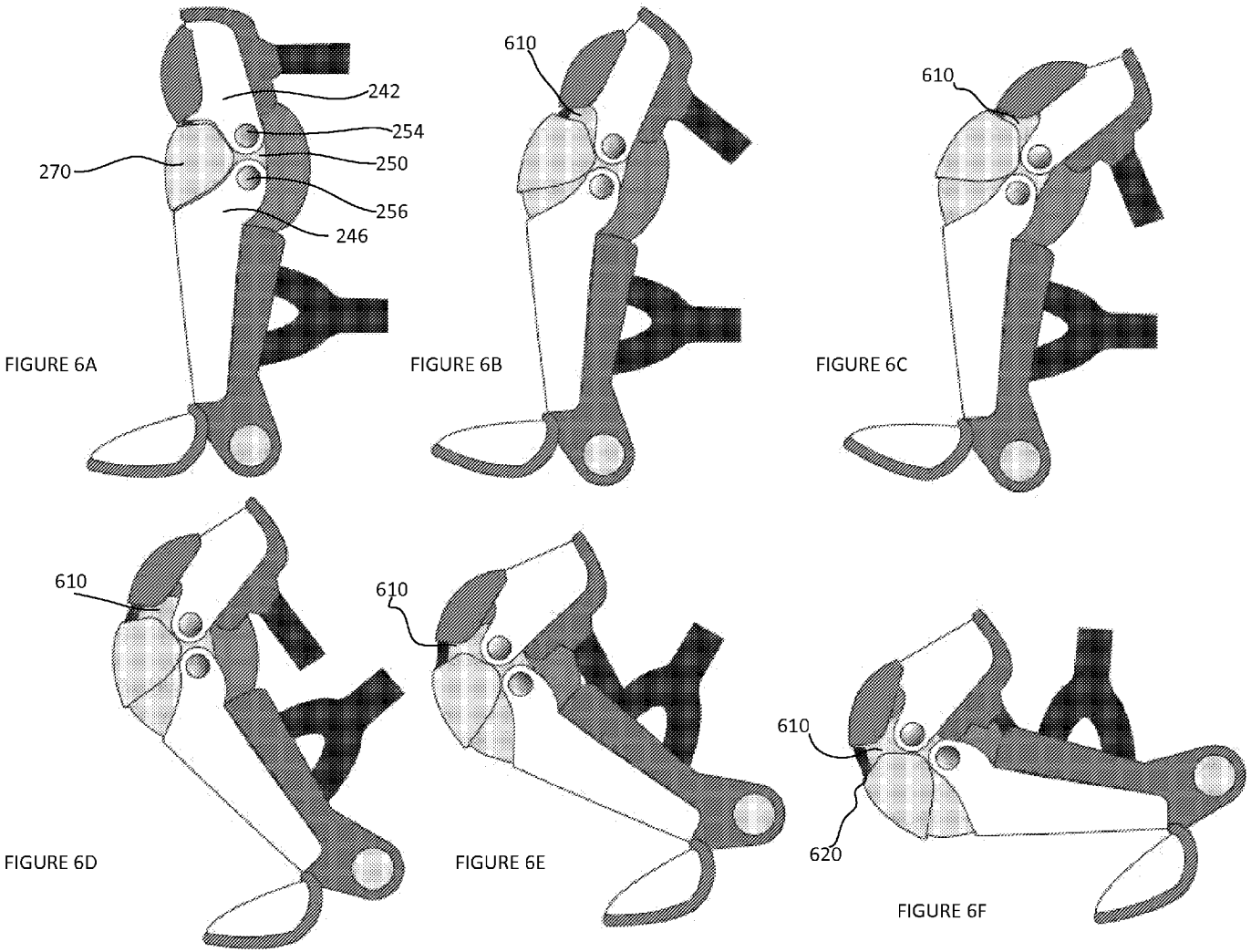
FIG. 6A-F is a series of side views showing the leg guard progressing from a standing position to a fully articulated crouching position.

With reference now to FIGS. 6A-F, a series of side view representations show the leg guard 100 progressing from a standing position to a fully articulated crouching position. These figures show, from a side perspective, the movements of leg guard 100 following the natural pattern of a user's movement of knee and leg. FIG. 6A shows the leg guard 100 in a fully standing position with the upper articulating arcuate joint portion 240 and lower articulating arcuate joint portion 246 fully closed. FIG. 6F shows the leg guard 100 in a fully articulated crouching position with the upper articulating arcuate joint portion 240 and lower articulating arcuate joint portion 246 fully open. FIG. 6B-E show the leg guard 100 in varying degrees of movement with the knee bent at varying angles. These figures demonstrate the range of motion of the leg guard 100, as it follows the natural knee and leg movement of a user. FIGS. 6B-6F also show an intermediate articulating portion 610 comprised of high impact resistant plastic for protection of the knee and upper leg is attached to the upper pivot point 254 and moved by the pivot plate 250. This intermediate articulating portion 610 comprised of high-impact resistant plastic prevents any gaps in protection of the knee; additionally, it contains an engaging ridge 620 curved inward to prevent the collection of dirt and debris in the knee area. Furthermore, FIGS. 6A-F show that the upper 240 and lower 246 articulating arcuate joint portion, the intermediate articulating portion 610 pivot from the two pivot plate 250 smoothly, allowing the arches not to protrude outward or create any gaps where dirt could collect and jam or slow their movement.

Figure 7A:
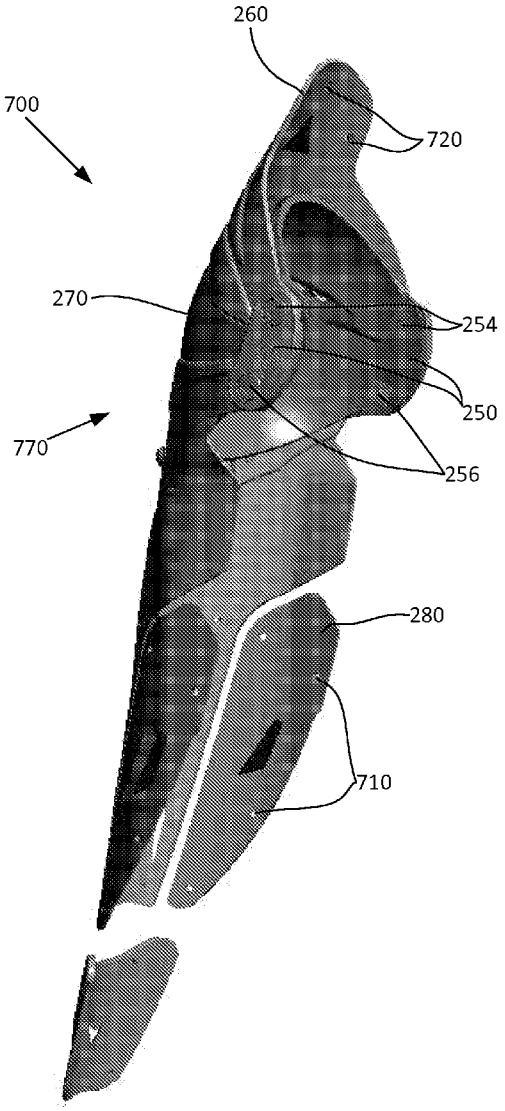
FIG. 7A is a rear perspective view of the rigid portions of an embodiment of the leg guard in the standing position with the hinged knee in a fully closed position.
Figure 7B:
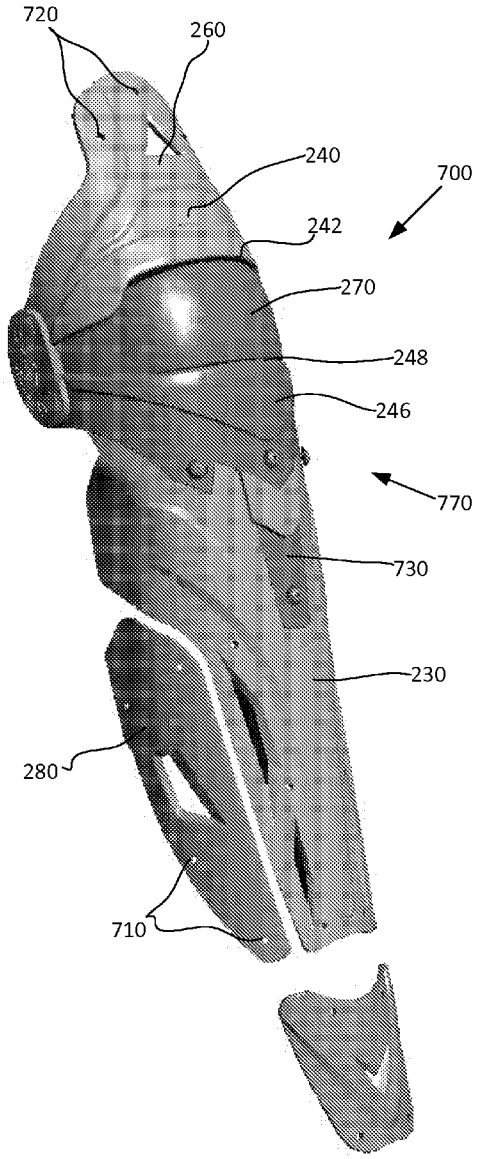
FIG. 7B is a front perspective view of the rigid portions of the leg guard of FIG. 7A in the standing position with the hinged knee in a fully closed position.

With respect now to FIGS. 7A-B, which both provide views of only the rigid portions of an embodiment of the leg guard 700 in the standing position with the hinged knee closed. With respect to FIG. 7A, a rear perspective view, the articulating joint assembly 770 can be seen. Additionally, the upper thigh impact panel 260, the winged side panel 280 of the lower leg, and the knee cup 270 can be seen. The predrilled holes for the rivets 710 and 720 connecting the foam padding to the shin panel 230 and to the thigh panel 260 are visible in this perspective. The interior of the pivot plate 250 and upper 254 and lower 256 pivot points can also be seen. With respect to FIG. 7B, a front perspective view, the adjustable shin panel 230 as well as the mechanism for adjusting the panel 730 are visible in the front perspective view. When the shin panel 230 is adjusted to increase the length of the leg guard 100, the adjustment mechanism 730 preferably includes a gap filler (e.g. a piece of high-impact resistant plastic), to maintain protection of the shin. The means for attaching the gap filler into place could be screws, pressure clips, button fascinators, a ratcheting locking mechanism, etc. Additionally, the articulating joint assembly 770, comprising the upper 240 and lower 246 articulating arcuate joint portions, is shown in the closed position. The engaging ridge 242 along the lower portion of the upper articulating arcuate joint portion 240 can be seen, as can the engaging ridge 248 along the upper portion of the lower articulating arcuate joint portion 246. Together, these engaging ridges prevent the collection of dirt and debris in the knee area and guide the articulation of the knee. Both FIG. 7A and FIG. 7B show the coverage of the front and sides of the leg with hard, high impact resistant plastic, demonstrating the large area protected.

Alternative embodiments of joint assembly 770 may be used for alternative joints or for alternate uses. Specifically, the joint assembly 770 may be configured for use for the knee, shoulder, or elbow. The joint assembly 770 may also be used in protective equipment in other sports such as hockey or skateboarding. Additionally, the joint assembly 770 may be used in protective equipment for non-sport uses, including law enforcement gear, military gear, or construction equipment. Furthermore, the joint assembly 770 may be used with or without shin guards 230.

Figure 8A:
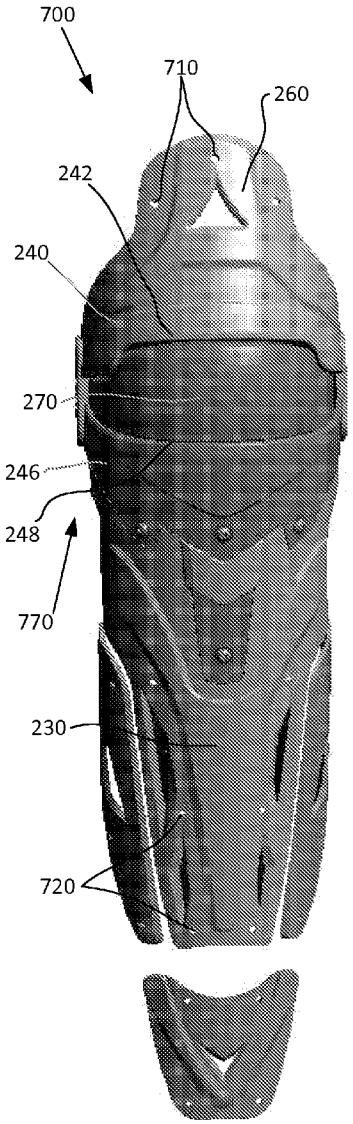
FIG. 8A is a front view of the rigid portions of the leg guard of FIG. 7A in a standing position with the hinged knee in a fully closed position.
Figure 8B:
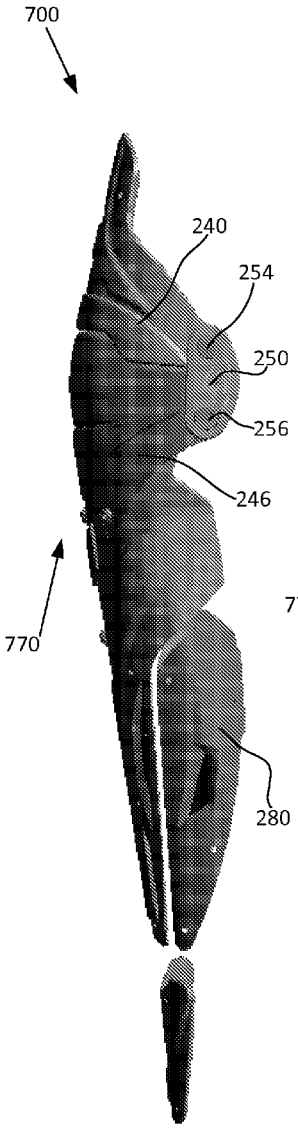
FIG. 8B is a side view of the rigid portions of the leg guard of FIG. 7A in a standing position with the hinged knee in a fully closed position.
Figure 8C:
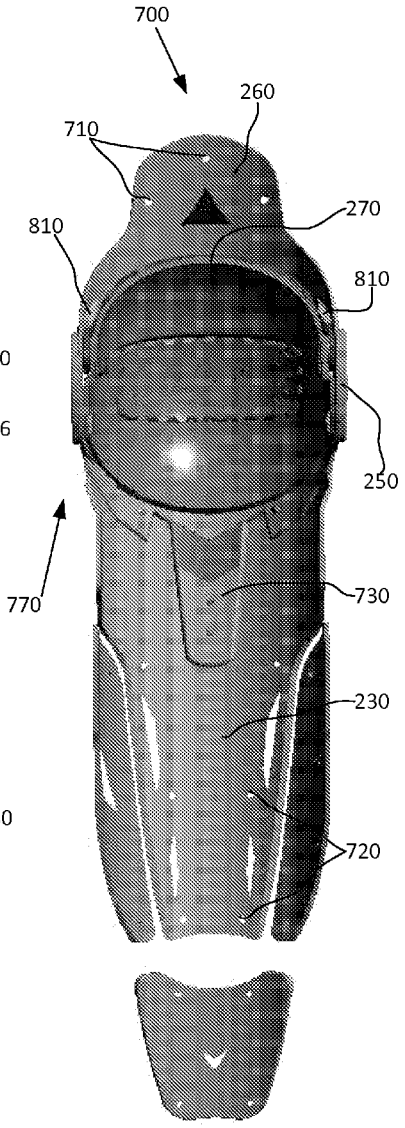
FIG. 8C is a rear view of the rigid portions of the leg guard of FIG. 7A in a standing position with the hinged knee in a fully closed position.

With respect now to FIGS. 8A-C, which also provide views of only the rigid portions of the leg guard 700 in the standing position with the hinged knee closed. With respect to FIG. 8A, a front view, the rigid portions of the leg guard 700 that can be seen are the upper thigh impact panel 260, the articulating joint assembly 770 comprising the upper 240 and lower 246 articulating arcuate joint portion along with their corresponding engaging ridges 242 and 248 and the knee cup/central articulating portion 270, and the adjustable shin guard portion 230. The pre-drilled holes for the rivets connecting the foam padding to the shin panel 710 and to the thigh panel 720 are also visible in this perspective. With respect to FIG. 8B, a side view, the rigid portions of the upper 240 and lower 246 articulating arcuate joint portions are closed in this perspective, and the winged side panel 280 is shown. Additionally, the side pivot plates 250, along with the upper pivot point 254 and lower pivot point 256 are shown. With respect to FIG. 8C, a rear view, the hard shell of the knee cup 270 can be seen before the addition of the foam padding. Additionally, the hard shell of the shin guard portion 230, the mechanism for adjusting the shin guard portion 730, and the thigh panel 260 can be seen before the addition of the foam padding. The pre-drilled holes for the rivets connecting the foam padding to the shin panel 710 and to the thigh panel 720 are visible in this perspective. This perspective also provides a rear view of side pivot plates 250. On both the right and left side of the upper articulating arcuate joint portion 240 there is an engaging tab 810 that functions as a stop in order to limit range of motion of the three articulating portions. As portion 240 moves towards a closed position the engaging tab 810 operatively engages with the upper edge of the intermediate articulating portion 610 (not seen in this perspective) to move the intermediate articulating portion 610 towards a closed position. FIG. 8A, FIG. 8B, and FIG. 8C show the coverage of the front and side of the leg with hard, high impact resistant plastic, demonstrating the large area protected.

Figure 9A:
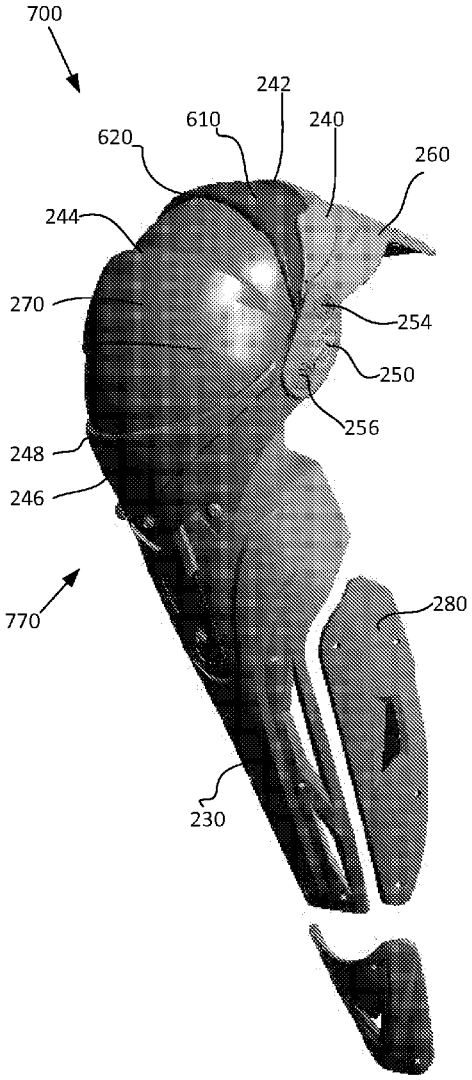
FIG. 9A is a front perspective view of the rigid portions of the leg guard of FIG. 7A in a crouching position with the hinged knee in a fully articulated open position.
Figure 9B:
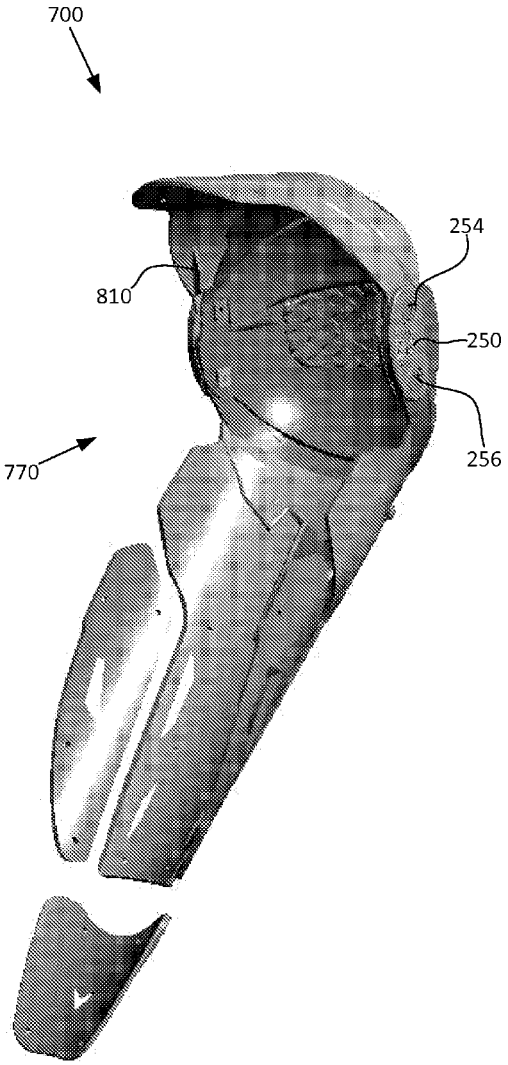
FIG. 9B is a rear perspective view of the rigid portions of the leg guard of FIG. 7A in a crouching position with the hinged knee in a fully articulated open position.
Figure 10A:
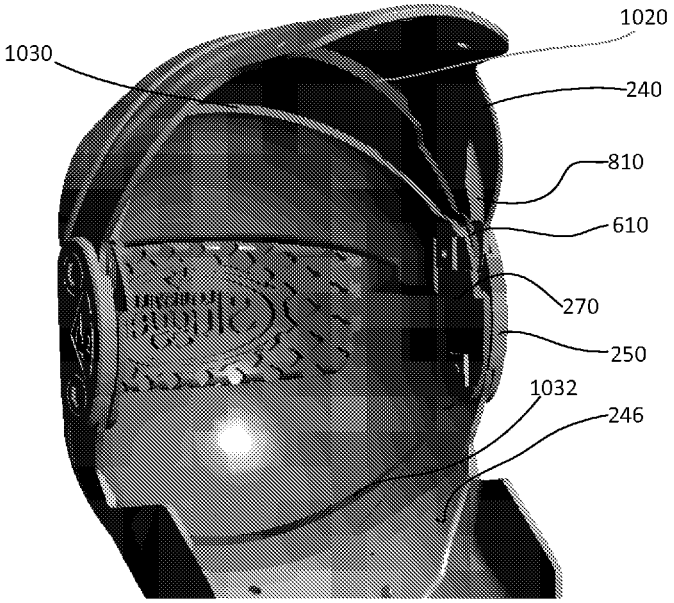
FIG. 10A is a partial rear perspective view of the rigid portions of the articulating knee portion of the leg guard of FIG. 7A in a fully articulated open position.

With reference now to FIGS. 9A-B, which shows views of only the rigid portions of the leg guard 700 in the crouching position with the hinged knee in a partially open position. With respect to FIG. 9A, a front perspective view of the rigid portion of the leg guard 700 shows the upper thigh panel 260, the shin guard portion 230, the winged side panel 280, and the knee cup/central articulating portion 270. Flexible fabric can be attached to the winged side panel 280 allowing for the panels to conform to the size dimension of the body of the user. The portion of the guard covering the knee also consists of an upper articulating arcuate joint portion 240 and a lower articulating arcuate joint portion 246, which cover both the upper and lower portions of the knee. The upper 240 and lower 246 articulating arcuate joint portions pivot about pivot plates 250 each with an upper pivot point 254 and a lower pivot point 256. In this perspective, it can clearly been seen that the upper 240 and lower 246 articulating arcuate joint portions have smoothly pivoted open, without protrusions where dirt and debris could be trapped. Additionally, there is an intermediate articulating portion 610 that provides further protection to the knee and upper leg by preventing any gaps in protection. This intermediate articulating portion 610 also articulates about the pivot plates 250. The engaging ridges 242 and 248 along with the engaging ridge 620 of the intermediate articulating portion 610, function in combination with the engaging tab 810 (see FIG. 9B) to guide and stop the articulation of the articulating portions. Specifically engaging ridges 248 and 620 engage with interior engaging ridges 1030 and 1032 as shown in FIG. 10A, and engaging ridge 242 engages with interior engaging ridge 1020, also shown in FIG. 10A. The pivot plate 250, upper pivot point 254, and lower pivot point 256 follow the natural movement of the upper and lower leg without leaving the protection and support of the kneecap and knee joint, protecting the knee from hyperextension. With respect to FIG. 9B, a rear perspective view shows the interior of the knee cup 270, the upper articulating arcuate joint portion 240 and the lower articulating arcuate joint portion 246 and the pivot plate 250 that operatively interacts with these portions. The upper articulating arcuate joint portion 240 contains an engaging tab 810 that functions as a stop in order to prevent further articulation of the three articulating portions.

Figure 10B:
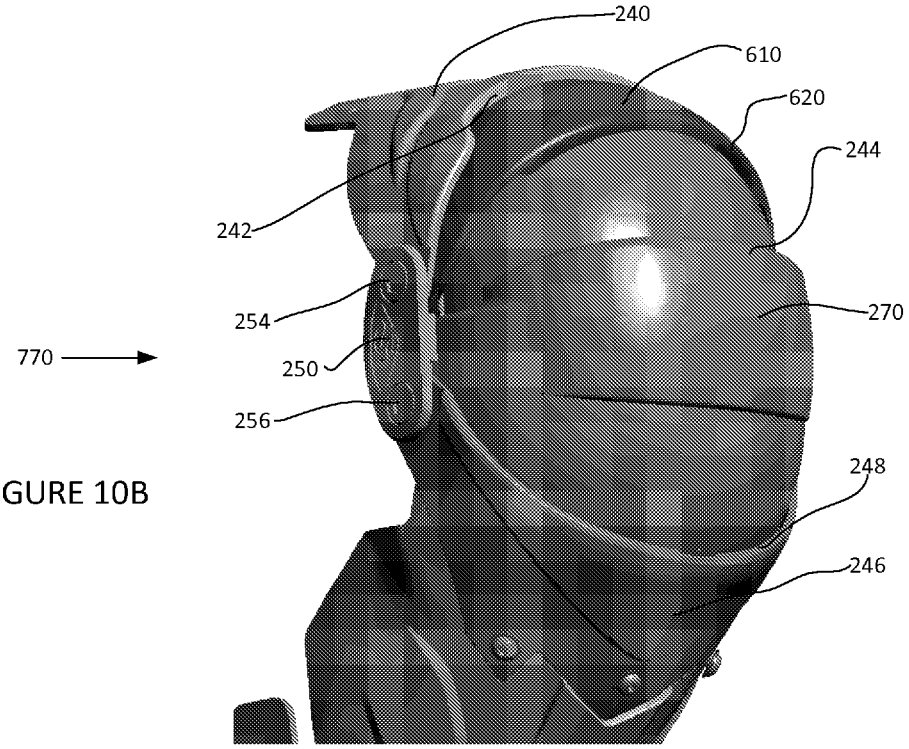
FIG. 10B is a partial front perspective view of the rigid portions of the articulating knee portion of the leg guard of FIG. 7A in a fully articulated open position.

With reference now to FIGS. 10A-B, enlarged views of the rigid portions of the articulating joint assembly 770 are shown in an open position. With respect to FIG. 10A, a rear perspective view, the interior of the knee cup/central articulating portion 270 prior to the addition of padding is shown. From this perspective it can be seen that the upper articulating arcuate joint portion 240, the intermediate articulating portion 610, and the central articulating portion 270 attach to the upper pivot point 254. It can also be seen that the lower articulating arcuate joint portions 246 and the central articulating portions 270 attach to the lower pivot point 256. The intermediate articulating portions contains an interior engaging ridge 1020 that engages with the exterior engaging ridge 242 of the upper articulating arcuate joint portion 240 to allow the articulation of the joint. The central articulating portion contains both an interior upper engaging ridge 1030 and interior lower engaging ridge 1032. The upper engaging ridge 1030 of the central articulating portion engages with the engaging ridge 620 on the exterior of the intermediate articulating portion 610 to allow for articulation of the joint. The lower engaging ridge 1032 of the central articulating portion engages with the engaging ridge 248 on the exterior of the lower articulating arcuate joint portion 246 to allow for articulation of the joint. The engaging tab 810 is attached to the rear of the upper articulating arcuate joint portion 240 and, along with the engaging ridges on the articulating portions, functions as a stop in order to prevent further articulation of the three articulating portions. With respect to FIG. 10B, a front perspective view, the exterior of the knee cup/central articulating portion 270 can be seen. The upper articulating arcuate joint portion 240, the lower articulating arcuate joint portion 246, and intermediate articulating portion 610 can be seen. The upper articulating arcuate joint portion 240 and the intermediate articulating portion 610 both contain a lower engaging ridges 242 and 620 (respectively) curving inward to prevent dirt and debris from entering the knee area and guide the articulation. The lower articulating arcuate joint portion 246 contains an upper engaging ridge 248 curving inward to prevent dirt and debris from entering the knee area and guide the articulation. These engaging ridges, in combination with the engaging tab 810, work to guide and stop the articulation of the portions. The central articulating portion contains a protrusion 244, so that when the hinged knee is in the fully open position that creates an internal cavity for additional padding. When in the standing position, this protrusion 244 creates a stop to prevent the knee from hyperextending.

While the invention has been described by reference to certain preferred embodiments, it should be understood that numerous changes could be made within the spirit and scope of the inventive concept described. Also, the present invention is not to be limited in scope by the specific embodiments described herein. It is fully contemplated that other various embodiments of and modifications to the present invention, in addition to those described herein, will become apparent to those of ordinary skill in the art from the foregoing description and accompanying drawings. Thus, such other embodiments and modifications are intended to fall within the scope of the following appended claims. Further, although the present invention has been described herein in the context of particular embodiments and implementations and applications and in particular environments, those of ordinary skill in the art will appreciate that its usefulness is not limited thereto and that the present invention can be beneficially applied in any number of ways and environments for any number of purposes. Accordingly, the claims set forth below should be construed in view of the full breadth and spirit of the present invention as disclosed herein.

What is claimed is:

1. A leg guard comprising:

a shin guard comprising high-impact resistant plastic;

a thigh guard comprising high-impact resistant plastic;

an articulating knee guard comprising high-impact resistant plastic and disposed intermediate of said shin guard and said thigh guard, said articulating knee guard movingly connected to a pair of side pivot plates, each of said thigh guard, knee guard, and said shin guard being attached to said pair of side pivot plates, whereby said thigh guard, knee guard, and shin guard are adapted to pivot between a closed position and an open position upon movement of user from a standing to a crouched position and to fully cover the front and sides of a user's knee through a full range of motion;

padding disposed on the interior of the leg guard and attached to one or more of the shin guard, thigh guard, and knee guard; and means for securing the leg guard to the leg of a user.

2. The leg guard of claim 1 wherein the leg guard further comprises a metatarsal plate comprising high-impact resistant plastic attached to said exterior layer and further comprising protective discs for the ankles.

3. The leg guard of claim 1 wherein the shin guard comprises a lower shin guard and an upper shin guard.

4. The leg guard of claim 1 wherein the shin guard further comprises a means for adjusting the length of the shin plate including an adjustment mechanism allowing the insertion of an additional piece of high-impact resistant plastic.

5. The leg guard of claim 1 further comprising a set of flexible padded layers adapted to be joined to the thigh guard, knee guard, and shin guard.

6. The leg guard of claim 5 wherein the flexible padded layers are comprised of a material selected from the group consisting of: EVA foam, Poron XRD, memory foam, Advanced Impact Composite, polymer blend, vinyl nitrile, self-skinned urethane foam, and gel impact pads.

7. The leg guard of claim 1 wherein the interior padding further comprises a shin pad and a means for attaching additional padding material to the high-impact resistant plastic.

8. The leg guard of claim 1 wherein the shin guard further comprises winged side panels comprising a flexible layer having an interior padded layer and an exterior layer wherein the exterior layer comprises high-impact resistance plastic and the interior padded layer further comprises flexible padding specific to either the right or left leg.

9. The leg guard of claim 1 wherein the shin guard further comprises an articulating arcuate joint portion connected to side pivot plates.

10. The leg guard of claim 1 wherein the interior padding of the articulating knee further comprises a knee pad, surrounded by a knee doughnut, and adjustable side panel knee pads.

11. The leg guard of claim 1 further comprising:

the thigh guard further comprising an upper stop ridge;

the shin guard further comprising a lower stop ridge;

the knee guard further comprising a protruding portion forming an upper ledge and a lower ledge adapted to engage respectively the upper stop ridge and lower stop ridge of said upper articulating arcuate joint portion and said lower articulating arcuate joint portion to limit further articulation when fully closed; and wherein the upper and lower articulating arcuate joint portions and the central articulating portion are connected to the pivot points on the pair of side pivot plates.

12. The leg guard of claim 11 wherein the leg guard is configured to articulate greater than ninety degrees without leaving areas unprotected.

13. The leg guard of claim 11 wherein the thigh guard further comprises a set of engaging tabs and engaging protrusion, the knee guard comprises an upper and lower engaging ridge, and the shin guard comprises an upper engaging ridge, configured to limit range of motion to prevent hyperextension of user's knee.

14. The leg guard of claim 11 wherein the pair of side pivot plates comprises an upper and lower pivot point wherein the shin guard and knee guard are connected to the lower pivot point, and the knee guard and thigh guard are connected to the upper pivot point.

15. The leg guard of claim 11 wherein an intermediate articulating portion is positioned between the thigh guard and knee guard.

16. The leg guard of claim 11 wherein the intermediate articulating portion further comprises an engaging protrusion.

17. The leg guard of claim 11 wherein the left and right double articulating pivot plates further comprise an upper and lower pivot point wherein the intermediate articulating portion connects to the upper pivot point.

18. An articulating protective piece for a body joint comprising:

an upper articulating arcuate joint portion having an upper stop ridge;

a lower articulating arcuate joint portion having a lower stop ridge;

a central articulating portion having a protruding portion forming an upper ledge and a lower ledge adapted to engage respectively the upper stop ridge and lower stop ridge of said upper articulating arcuate joint portion and said lower articulating arcuate joint portion to limit further articulation when fully closed; and left and right double articulating pivot plates having a set of pivot points;

wherein the upper and lower articulating arcuate joint portions and the central articulating portion are connected to the pivot points on the left and right double articulating pivot plates, said upper and lower articulating arcuate joint portions adapted to articulate relative to said central articulating portion.

19. The articulating protective piece of claim 18 wherein the articulating protective piece is configured to articulate greater than ninety degrees without leaving areas unprotected.

20. The articulating protective piece of claim 18 wherein an intermediate articulating portion disposed intermediate between said upper and central portions.

21. The articulating protective piece of claim 20 wherein the intermediate articulating portion further comprises an upper and lower edge, an intermediate engaging ridge positioned on said upper edge, and an intermediate stop ridge positioned on said lower edge.

22. The articulating protective piece of claim 20 wherein the left and right double articulating pivot plates further comprise an upper pivot point and lower pivot point, the intermediate articulating portion connected to the upper pivot point.

23. The articulating protective piece of claim 18 further comprising:

an intermediate articulating arcuate portion having an upper and lower edge, an intermediate engaging ridge disposed on said upper edge, and an intermediate stop ridge disposed on said lower edge;

the upper articulating arcuate joint portion further comprising a set of engaging tabs adapted to engage said upper edge of said intermediate articulating arcuate portion;

the central articulating portion further comprising an upper and lower engaging ridge, said upper engaging ridge adapted to engage said intermediate stop ridge, and said lower engaging ridge adapted to engage said lower stop ridge.

24. The articulating protective piece of claim 18 wherein the left and right double articulating pivot plates further comprise a lower pivot point and an upper pivot point wherein the lower articulating arcuate joint portion and central articulating portion are connected to the lower pivot point, and the central articulating portion and upper articulating arcuate joint portion are connected to the upper pivot point.

25. The articulating protective piece of claim 18 wherein the upper articulating arcuate joint portion further comprises interior flexible padding.

26. The articulating protective piece of claim 18 wherein the central articulating portion further comprises interior flexible padding and adjustable side padding.

27. The articulating protective piece of claim 18 wherein the lower articulating arcuate joint portion further comprises a shin guard portion with interior padding.

28. The articulating protective piece of claim 27 wherein the shin guard further comprises winged side panels comprising a flexible layer having an interior padded layer and an exterior layer wherein the exterior layer comprises high-impact resistance plastic and the interior padded layer further comprises flexible padding specific to either the right or left leg.

* * * * *